United States Patent [19]

Meywald

[11] 4,163,146

[45] Jul. 31, 1979

[54] ELECTRICAL HEATING ELEMENT COMPRISING A HELIX OF WIRE WOUND ON AT LEAST ONE INSULATING PLATE

[75] Inventor: Klaus Meywald, Kandel, Fed. Rep. of Germany

[73] Assignee: Firma Fritz Eichenauer, Fed. Rep. of Germany

[21] Appl. No.: 834,052

[22] Filed: Sep. 16, 1977

[30] Foreign Application Priority Data

Sep. 30, 1976 [DE] Fed. Rep. of Germany ..... 2644093

[51] Int. Cl.[2] ..... H05B 3/06

[52] U.S. Cl. ..... 219/542; 219/536; 219/541; 219/552; 338/218; 338/286; 339/258 R; 339/258 P

[58] Field of Search ..... 209/345, 375, 532, 536, 209/537, 538, 541, 542, 552, 553; 338/218, 286, 301; 339/14 R, 258 R, 258 P, 258 S, 221

[56] References Cited

U.S. PATENT DOCUMENTS

| | | | |
|---|---|---|---|
| 2,530,806 | 11/1950 | Boxrud | 219/542 |
| 2,536,925 | 1/1951 | Forss | 219/541 X |
| 2,817,068 | 12/1957 | Schwing | 339/221 |
| 2,997,569 | 8/1961 | Wayner | 219/542 X |
| 3,634,654 | 1/1972 | Peetz et al. | 219/522 |
| 3,784,963 | 1/1974 | DeCenzo | 339/258 P X |
| 4,058,789 | 11/1977 | Bavisotto et al. | 219/553 X |

FOREIGN PATENT DOCUMENTS

| | | | |
|---|---|---|---|
| 177735 | 4/1922 | United Kingdom | 219/542 |

*Primary Examiner*—Volodymyr Y. Mayewsky
*Attorney, Agent, or Firm*—Craig and Antonelli

[57] ABSTRACT

A heating element comprises a resistance heating wire formed with closely adjacent zigzag loops and wound helically on an insulating plate or a pair of such plates mounted crosswise and possibly narrowing conically towards one end. Opposite loops engage the respective edges of such insulating plate, possibly in notches in those edges, and may be pressed on to those edges. The plate may have holes near its edges, the engaging loops being formed with kinks which clip into the holes. Spring clips may be provided for electrical connections to such loops at the edge of such plate and may also be formed with kinks which clip into the said kinks of the loops. The electrical connection to such spring clip may be a cable rivetted, eyeletted or soldered to a cross-piece interconnecting the legs of the clip or may comprise an angled tongue formed at the end of one of the legs to receive a flat plug-in connector. A temperature regulating device may be located within the helical winding and may be readily connected to the heating element by means of such connectors.

11 Claims, 12 Drawing Figures

ELECTRICAL HEATING ELEMENT COMPRISING A HELIX OF WIRE WOUND ON AT LEAST ONE INSULATING PLATE

The invention relates to electrical heating elements having at least one plate of insulating material and having a helix wound continuously about the said plate, the said helix consisting of electrical resistance heating wire whose turns are secured by means of bends therein on the two longitudinal edges of the plate of insulating material.

In heating elements conforming to the above general description, as disclosed in German published specification No. 1,805,639, the helix is circular or rhomboidal in shape, so that both above and below the plate of insulating material there is a portion of the heating wire which is of semi-circular or pointed arch shape, these portions being connected with one another by the said bends. The bends are formed on each turn in positions opposite one another as far as the parallel positions of the resistance heating wire, and engage securely about the longitudinal edges of the plate of insulating material.

However, known heating elements which are produced on a so-called layer winding machine have the disadvantage of poor shape-retaining ability, due more particularly to the small semi-circular bends which are used. This small bend in fact does not ensure that the turns of the helix are retained permanently and securely on the plate of insulating material. When operating in heating appliances which are provided with a fan, vibrations and the flow of air delivered by the fan may cause the bends to slip if the heating element is subjected to considerable thermal load and consequently expands. More particularly with helically coiled heating elements having freely suspended turns, this may result in undesirable inter-turn short circuits. However, with the layer winding machine it is not possible to produce bends with relatively large dimensions, since the resistance heating wire has always to be wound with tension on the plate of insulating material, and this only allows a bend of small extent.

It is in fact possible, in principle, to provide relatively large bends in a heating element of the kind described above, but in that case the helixes must first be preshaped, the bends subsequently formed, and then the plate of insulating material wound, which procedure would make such heating elements disproportionately expensive.

The invention has as a principal object to provide a heating element of the type initially described above, whose helix can be secured more reliably and permanently on the plate of insulating material without providing special bends, and has good shape-retaining ability.

This object is achieved according to the present invention in that each of the said turns consists of closely adjacent zigzag-shaped loops and that two opposite loops of each turn form the bends for securing to the plate of insulating material.

This construction affords the advantage that no special bends have to be formed on the helix, and on the contrary the loops of the helix themselves are used for fixing it on the insulating plate. Furthermore the individual turns of the helix are secured to a very considerable extent against the possibility of slipping since the plate of insulating material is surrounded by the loops over the entire length thereof. For the same reason and because of the fact that each turn consists of zigzag-shaped loops situated close together, the advantage of very good shape-retaining ability is obtained. The helix retains its shape even when mechanical stresses act on it directly, since it has a certain amount of elasticity. Moreover the helix with the zigzag loops can also be wound mechanically on the plate of insulating material.

According to a preferred constructional form of the invention, the longitudinal edges of the plate of insulating material comprise spaced-apart indentations or notches in which the tips of the loops forming the bends are secured, to prevent them from slipping. Advantageously the loops secured on the longitudinal edges are also pressed on at both sides of the plate of insulating material.

According to an alternative constructional form, the plate of insulating material is provided with holes near its longitudinal edges and the loops fitted over the longitudinal edges have indentations or kinks which engage resiliently in these holes, whereby it is possible to dispense with the above-mentioned shoulders at the longitudinal edges of the plate of insulating material for providing security against slipping.

To further improve the shape-retaining ability of the heating element according to the invention, the turns of the helix are arranged on the longitudinal edges of two such plates of insulating material which are arranged crosswise relatively to one another. The plates may be formed to narrow conically towards one end.

Furthermore, in an advantageous further feature of the heating element according to the present invention, it is proposed that voltage tappings constructed as spring clips are fitted on to the loops secured on the longitudinal edges of the plate of insulating material, in order for example to make it possible to supply the fan motors, designed for low voltages, with the necessary low electrical voltage. Advantageously the spring clips are fork-shaped having a cross-piece and include at their cross-piece an electrical connection for a cable, and the spring clips preferably have inward protrusions or kinks which engage in the above-mentioned kinks or indentations of the loops.

Conveniently, the electrical connection of the spring clips is constructed as a tongue bent over at an angle for receiving flat plugs.

Further features, details and advantages of the invention will become clear from the following description, given by way of example and with reference to the accompanying drawings, of two embodiments of the invention.

Figure 1:
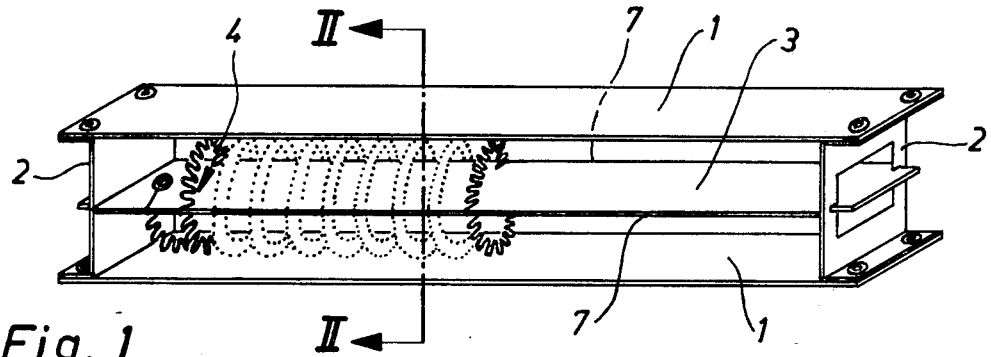
FIG. 1 shows a constructional form of heating element embodying the invention in perspective view.

The heating element shown in FIG. 1 consists of two support plates 1 which are arranged with a spacing from one another and which are held spaced from one another by means of laterally attached U-shaped spacer elements 2. A plate 3 of insulating material is situated between the two support plates 1. A helix 4 which consists of electrical resistance heating wire, preferably of square cross-section, and which is provided with zigzag-shaped loops, is wound helically about the insulating plate 3.

Figure 2:
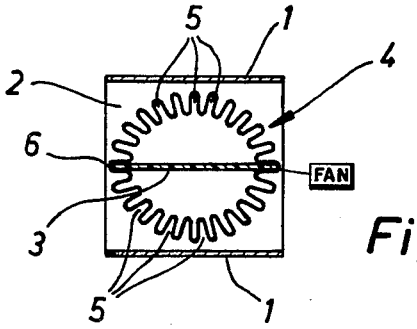
FIG. 2 shows a section on II—II according to FIG. 1.
Figure 3:
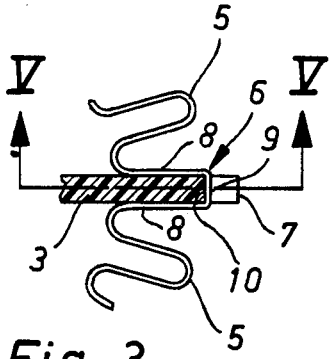
FIG. 3 shows a detail according to FIG. 2, on a larger scale.

Each turn of the helix comprises closely spaced zigzag-shaped loops 5, as shown in FIG. 2. Two opposite loops 6 in each turn are fitted on to the longitudinal edges 7 of the plate 3 of insulating material and then pressed in position so that the two legs 8 abut against the top and bottom surfaces of the plate 3 of insulating material (FIG. 3) whereas the tip 9 of the loop 6 abuts securely against the longitudinal edge 7.

Figure 5:
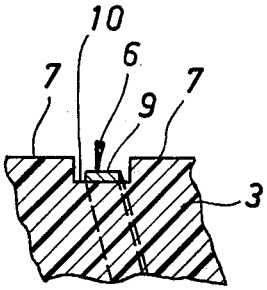
FIG. 5 shows a section on V—V of FIG. 3.

Arranged on the longitudinal edges 7 are notches or indentations 10 which are spaced from one another (FIG. 5) and in which the tips 9 of the loops 6 are arranged in such a manner that they are secured against lateral slipping.

Figure 4:
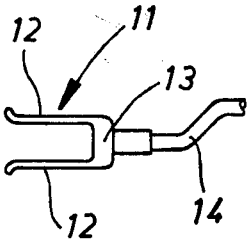
FIG. 4 shows a spring clip used as a voltage tapping point for fitting on to the zigzag-shaped loop of electrical resistance heating wire which is secured on a plate of insulating material.

A spring clip 11 as shown in FIG. 4 can be fitted on to the loop 6 in order to provide for the tapping of a voltage or a graduated power supply. The spring clip 11 is fork-shaped having two prongs 12 and a cross-piece 13 to which an electrical cable 14 is secured for example by eyeletting, rivetting or soldering.

Figure 6:
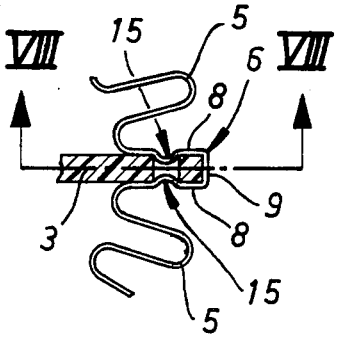
FIG. 6 shows a constructional form which is an alternative to the method of fixing used in FIG. 3.

FIG. 6 shows another method of attaching the loop 6, which in this case is formed with kinks or indentations 15 in its legs 8. These indentations 15 are directed towards one another and engage in holes 16 in the plate of insulating material 3, which are spaced from one another and from the longitudinal edges 7 of the plate of insulating material. The resilient engagement of the indentations 15 in the holes 16 ensures that the loop 6 can abut securely with its tip 9 against the longitudinal edge 7 and with its legs 8 against the top and bottom surfaces of the plate of insulating material.

Figure 7:
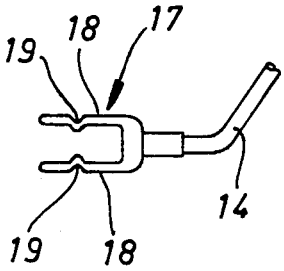
FIG. 7 shows a spring clip used as a voltage tapping for the constructional form shown in FIG. 6.
Figure 8:
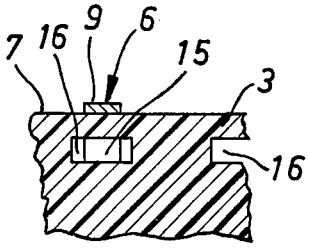
FIG. 8 shows a section on VIII—VIII of FIG. 6.

The spring clip 17 shown in FIG. 7 is provided for the loops 6 which are provided with the indentations 15, and again an electrical cable 14 is connected to the said spring clip. The spring clip 17 is likewise generally fork-shaped and its two prongs 18 have kinks or inward protrusions 19 which on fitting on to the loop 6 also lock resiliently into the indentations 15 of the loop 6.

Figure 9:
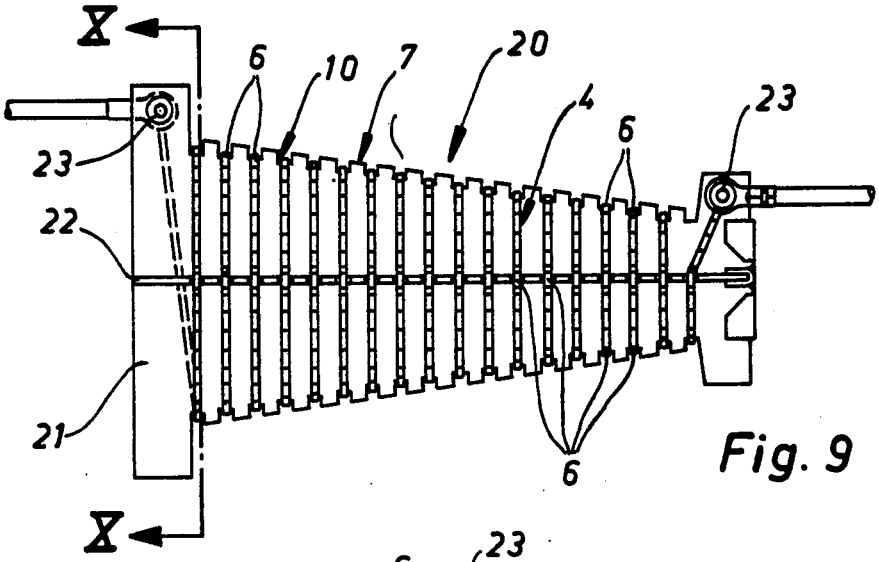
FIG. 9 shows a second constructional form of heating element embodying the invention having two crosswise plates of insulating material situated at right-angles to one another.
Figure 10:
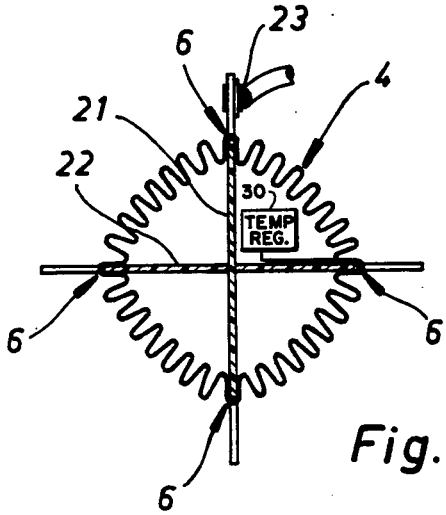
FIG. 10 shows a section on X—X of FIG. 9.

In FIG. 9 there is shown a second constructional form of heating element 20 embodying the present invention. This comprises two insulating material plates 21, 22 which are fitted crosswise on one another, and narrow conically towards one end. At their longitudinal edges 7 the two insulating material plates 21, 22 are provided with notches or indentations 10 in which the loops 6 are secured. The beginning and the end of the helix 4 are rivetted for example by means of rivets 23, or eyeletted, on the insulating material plate 21.

This constructional form of the heating element according to the invention is particularly suitable for insertion in elongated throughflow ducts of relatively small diameter, such as are provided for example in hair driers. In contrast to the heating element shown in FIG. 1 and FIG. 2, each turn of the helix in the heating element 20 shown in FIG. 9 is supported four times on the longitudinal edges 7 or the shoulders 10 respectively of the insulating material plates 21, 22 instead of only at two places on the periphery. Because of this, there is obtained a heating element of very good shape-retaining ability which is particularly robust and is substantially unaffected by mechanical stresses.

Figure 11:
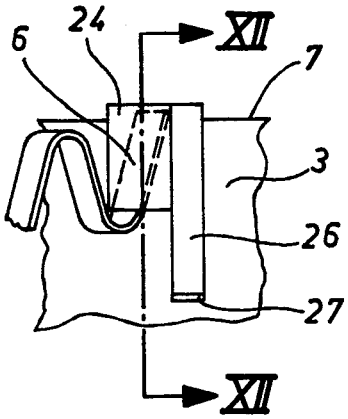
FIG. 11 shows a further constructional form of a spring clip which is used as a voltage tapping.
Figure 12:
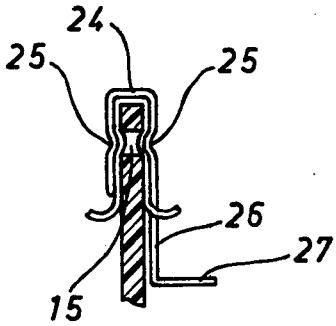
FIG. 12 shows a section taken on XII—XII of FIG. 11.

FIG. 11 shows a further constructional form of a spring clip which is used as a voltage tapping and which can be used both in the heating element as shown in FIG. 1 and in the heating element as shown in FIG. 9. It comprises a spring clip 24 which is provided with kinks or inward protrusions 25—similar to the inward protrusions 19 in the spring clip 17 shown in FIG. 7, —and which engages resiliently, with these protrusions in the indentations 15 of the loop 6 (FIG. 12). The spring clip 24 is provided with a connecting arm 26 on one side, the end of which is bent over at right-angles for use as a tongue 27 for receiving flat plug-in connectors. This constructional form of spring clip has the advantage that a temperature regulating device or the like 30, on the insulating material plates 3, 21, 22 within the helix, can be connected in a simple manner by fitting its connections, provided with flat plug-in connectors, on to the tonques 27 of the connecting arms 26.

What is claimed is:

1. A heating device comprising:

(a) at least one supporting plate of insulating material;

(b) a heating element comprised of a resistance heating wire which is bent in a meander shape formed of zigzag shape loops and wound in a helix about the supporting plate, said resistance heating wire being provided with opposed loops which are fitted over longitudinal edges of the supporting plate; and, (c) voltage taps fitted on said loops secured to the longitudinal edges of the insulating material, said voltage taps being formed by bifurcate spring clips having a forked web and an electrical connector for enabling lower voltages to be tapped from said heating wire to power other components of the heating device.

2. A heating device according to claim 1, wherein the longitudinal edges of the plate of insulating material comprise spaced-apart indentations in which the tips of the loops forming the bends are secured.

3. A heating device according to claim 1, wherein the loops secured on the longitudinal edges are pressed on at both sides of the plate of insulating material.

4. A heating device according to claim 1, wherein the insulating material plate is provided near its longitudinal edges with holes, and wherein the loops fitted over the longitudinal edges of the plate of insulating material have indentations which latch resiliently into these holes.

5. A heating device according to claim 1, wherein the loops are arranged on the longitudinal edges of two such plates of insulating material arranged crosswise relatively to one another.

6. A heating device according to claim 5, wherein the insulating material plates narrow conically towards one end.

7. A heating device according to claim 4, wherein the spring clips have protrusions which engage in indentations of the loops.

8. A heating device according to claim 1, wherein the spring clips have electrical connections which are constructed as a tongue bent over at an angle for receiving flat plug-in connectors.

9. A heating device according to claim 1, further comprising:

(d) a low voltage fan motor connecting to said voltage taps.

10. A heating device according to claim 1, further comprising:

(d) a temperature regulating device connected to said voltage taps.

11. A heating device according to claim 1, wherein said spring clips have protrusions which engage in identations of the loops.

* * * * *